United States Patent [19]

Davis

[11] Patent Number: 4,854,589

[45] Date of Patent: Aug. 8, 1989

[54] GAME

[76] Inventor: Emsley A. Davis, 1616 Colcord Ave., Waco, Tex. 76707

[21] Appl. No.: 92,183

[22] Filed: Sep. 2, 1987

[51] Int. Cl.[4] ..... A63F 7/00; A63F 7/06

[52] U.S. Cl. ..... 273/123 R; 273/85 R; 273/128 R

[58] Field of Search ..... 273/85 R, 86 R, 123 R, 273/126 R, 58 F, 428, 108, 118 R

[56] References Cited

U.S. PATENT DOCUMENTS

| | | | |
|---|---|---|---|
| 693,821 | 2/1902 | Ford | 273/58 F |
| 1,634,016 | 6/1927 | Brown | 273/85 R |
| 2,152,882 | 4/1939 | Engel | 273/85 R |
| 2,794,639 | 6/1957 | Christain | 273/118 R |
| 2,981,542 | 4/1961 | Weiss | 273/123 R |
| 3,158,373 | 11/1964 | Hastings | 273/118 R |
| 3,995,855 | 12/1976 | Schultz | 273/58 F |
| 4,018,443 | 4/1977 | Bird | 273/85 R |
| 4,244,584 | 1/1981 | Viveiros | 273/128 R |
| 4,261,568 | 6/1981 | Such | 273/85 R |
| 4,274,635 | 6/1981 | Pakogian | 273/85 R |
| 4,283,054 | 8/1981 | Patella et al. | 273/126 R |
| 4,408,761 | 10/1983 | McAllister | 273/85 R |
| 4,560,163 | 12/1985 | Erickson | 273/85 R |
| 4,616,827 | 10/1986 | Bergland | 273/428 |
| 4,765,622 | 8/1988 | Rienzo | 273/85 R |

FOREIGN PATENT DOCUMENTS

| | | | |
|---|---|---|---|
| 525672 | 7/1954 | Belgium | 273/85 R |
| 496250 | 9/1953 | Canada | 273/85 R |
| 2333073 | 1/1975 | Fed. Rep. of Germany | 273/85 R |
| 478366 | 2/1953 | Italy | 273/85 R |
| 5572 | 3/1891 | United Kingdom | 273/85 R |

OTHER PUBLICATIONS

"Kick The Can . . . " Darwin A. Hindman, Prentice-Hall Inc., Englewood Cliffs, N.J., 1951 pp. 409-411, Scientic Library

*Primary Examiner*—Edward M. Coven
*Assistant Examiner*—Gary Jackson
*Attorney, Agent, or Firm*—Arthur F. Zobal; James C. Fails; Geoffrey A. Mantooth

[57] ABSTRACT

There is disclosed apparatus and methods for playing a game between two opposing sides. One version of the game is played on a board by two or more players. The board has a top surface with markings dividing the top surface into two areas of play and a neutral area. The areas of play are separated from one another by the neutral area. Markings delineate circular nonoverlapping zones within each area of play. Scoring pockets are located within each area of play. The playing ball includes two bowl shaped portions joined together at their open ends. A small shperical ball is inside the playing ball and openings in the bowl shaped portions communicate between the exterior and the interior space of the playing ball. Sticks having foot shaped protuberances are used by the players to strike the ball and to defend the scoring pockets. Men in the form of vertical playing pieces are adapted to be located in the zones and are used for defensive purposes. Another version of the game is played on a court having a layout similar to the board. Each side has a plurality of players to be located in the zones.

4 Claims, 4 Drawing Sheets

FIG. 1
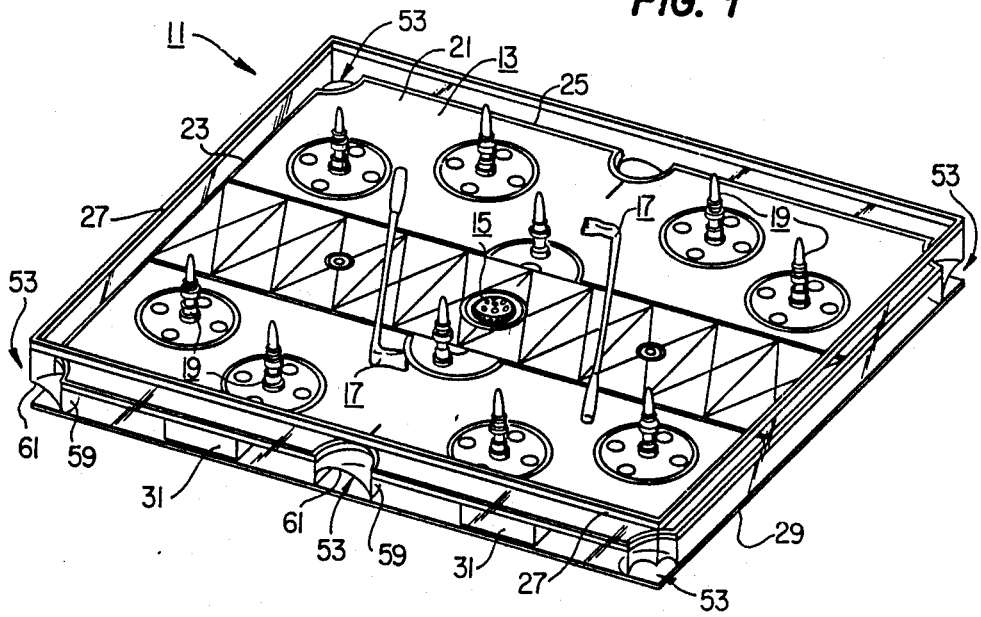
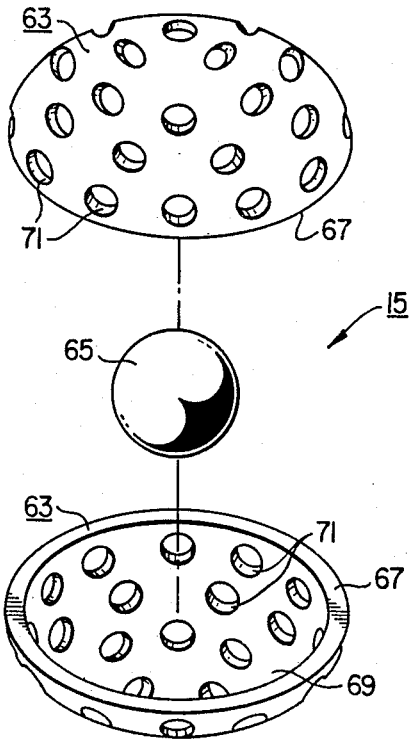
FIG. 3
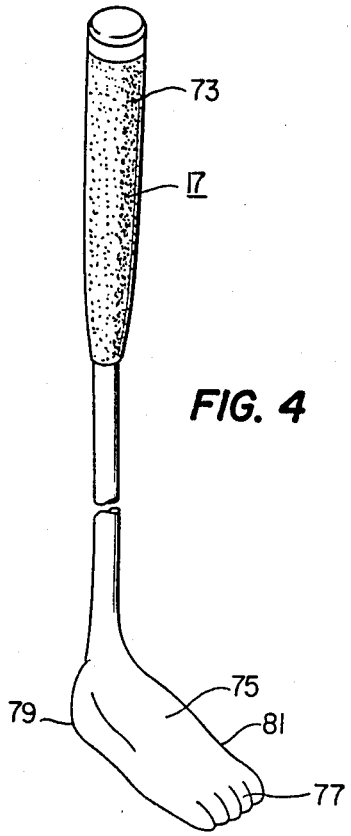
FIG. 4

GAME

FIELD OF THE INVENTION

The invention pertains to a novel game which may be played on a game board or on a court, such as a hardwood floor or lawn.

SUMMARY OF THE INVENTION

It is an object of the present invention to provide methods and apparatus for playing a novel game.

The method of playing the game of the present invention, wherein there are two opposing sides, comprises the steps of striking a ball with a stick by each side in turn with the objective of placing the ball into an appropriate scoring pocket and then defending against the placement of the ball into an appropriate scoring pocket by the opposing side. Each side is limited in movement to within its own designated rectangular area of play. The two areas of play are separated from one another by a neutral area. Each area of play has a plurality of scoring pockets and each side tries to place the ball into one of the scoring pockets located within the opposing side's area of play. Neither side can enter the neutral area to strike the ball, or defend against the ball, after the initiation of playing action. Each side has a plurality of men whose defensive movements are limited to specific zones located within the respective areas of play and between the scoring pockets and the neutral area.

In one aspect, the game is played by two or more players on a rectangular board. The board has a top surface with markings dividing the top surface into the areas of play and into the neutral area. The markings also delineate the zones. Side wall means extend along the side edges of the board and is oriented perpendicularly to the board top surface. The board has scoring pocket means bordering the areas of play. The scoring pocket means have openings formed by notches in the board and by the side wall means. Sticks are used to strike a playing ball. The men are vertical playing pieces located within the zones. The players manipulate the sticks to strike the ball and for defensive purposes. The players also manipulate the positions of the men within their respective zones.

In another aspect, the stick has upper and lower ends. A foot shaped protuberance projects outwardly from the lower end at an approximate right angle with the stick longitudinal axis. The ball is struck with the foot shaped protuberance. In a further aspect, the ball includes two bowl shaped portions, each of which has an open end. The diameter of the open end is greater than twice the height of the bowl shaped portion. The bowl shaped portions are joined together at the open ends to form an interior space. The bowl shaped portions have a plurality of openings communicating between the exterior of the ball and the interior space. Located within the interior space of the ball is a smaller spherical ball.

In a still further aspect, the game is played on a court with each side comprising the men, who are players. The players manipulate sticks for striking the ball and defending the scoring pockets.

In still a further aspect, the speed of play is regulated by requiring each side to strike the ball within a predetermined period of time after the ball has come to rest in each sides respective area of play.

The game of the present invention requires hand-eye coordination, memory and precision movements. By requiring the ball, which is made up of bowl shaped portions, to be struck with the irregular surfaces of the foot shaped protuberance of the stick, the level of difficulty is increased. The ball is inherently unstable due to the small inner ball and the openings.

BRIEF DESCRIPTION OF THE DRAWINGS

FIG. 1 is an isometric view of the equipment which is utilized in playing the board version of the present invention in accordance with a preferred embodiment.

FIG. 3 is a schematic exploded isometric view of the playing ball of FIG. 1.

FIG. 4 is a schematic fragmentary isometric view of a stick of FIG. 1.

DESCRIPTION OF THE PREFERRED EMBODIMENTS

Figure 2:
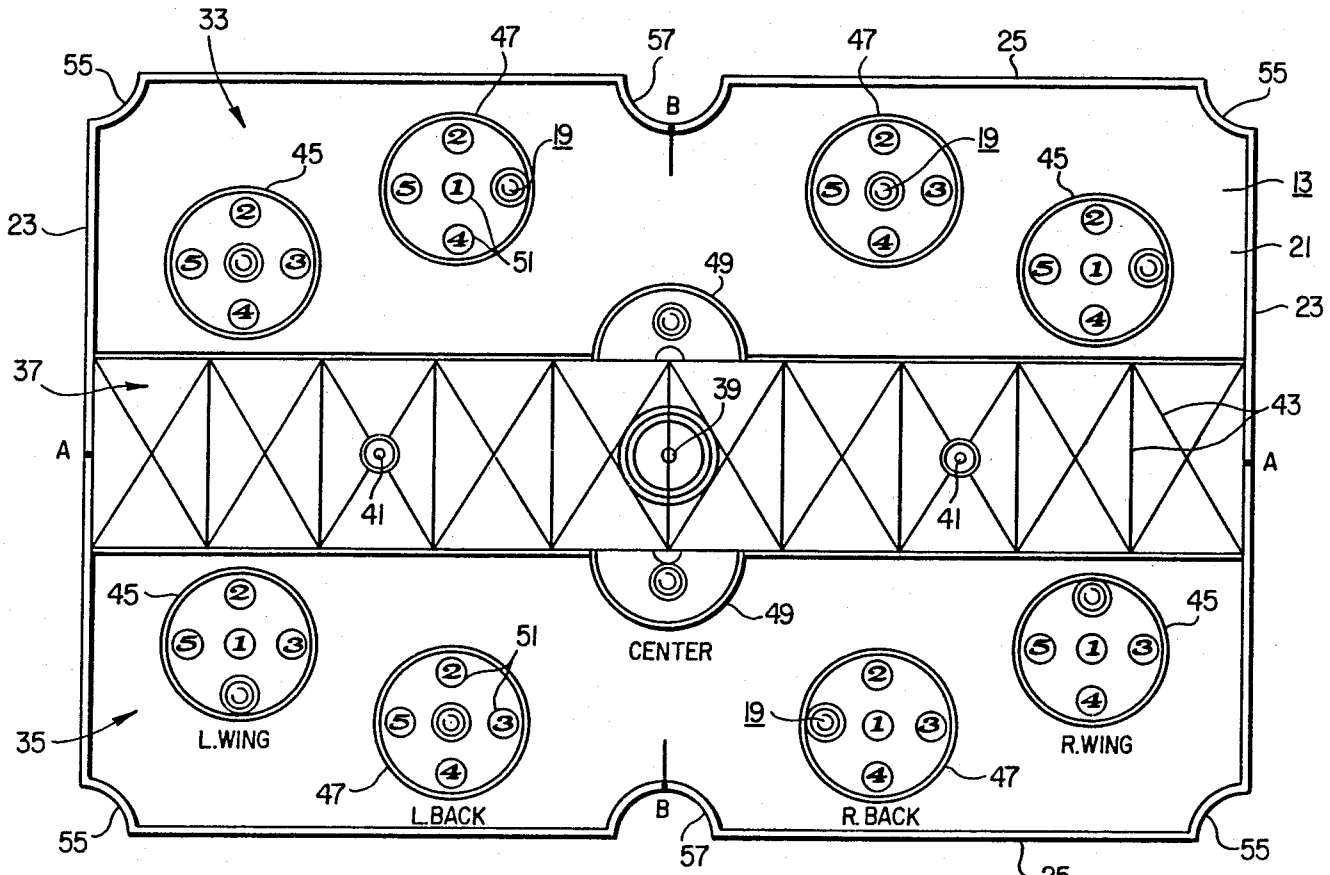
FIG. 2 is a plan view of the playing board of FIG. 1.

The game of the present invention can be played on either a board or on a court. The board version of the game will be described first.

Referring to FIG. 1, the equipment for playing the board version 11 of the game of the present invention includes a playing board 13, a playing ball 15, sticks 17 for each player and men 19.

The playing board 13 is a rectangular board having a top surface 21, short edge surfaces 23 and long edge surfaces 25. Transparent side walls 27 enclose the board by extending along the board edge surfaces 21, 23. The side walls 27 are oriented perpendicularly to the top surface 21 and extend both above and below the edge surfaces. The side walls 27 are joined together by a rectangular bottom wall 29, which is the same size and shape as the board 13. The combination of the side walls 27 and the bottom wall 29 form a rectangular container with the playing board recessed within the container. Support members 31 extending beneath the board 13 position the board midway between the upper and lower edges of the side walls 27 such that the side walls extend above the top surface 21 of the board a sufficient distance so as to provide a reflective surface for the ball.

Referring to FIG. 2, the top surface 21 of the board has markings dividing the top surface into first and second areas of play 33, 35 and a neutral area 37. The three areas are rectangular in shape and are positioned relative to each other such that the first and second areas of play 33, 35 are separated from one another by the neutral area 37. The neutral area extends between the two short edge surfaces 23 of the board. The two areas of play have the same areal dimensions. In describing the markings in further detail, it will be convenient to refer to imaginary lines A—A and B—B which are the perpendicular bisectors of the short edge surfaces 23 and the long edge surfaces 25 respectively. In the neutral area 37, at the junction of lines A-A and B-B, lies a center spot 39 where play is initiated. Restart spots 41 lie along line A—A, halfway between the center spot 39 and the short edge surfaces 23. The neutral area 37 is visually distinguishable from the areas of play by numerous linear and cross markings 43. Each area of play has a plurality of nonoverlapping zones; two circular zones 45, two circular zones 47, and a semi-circular zone 49. In each area of play, two of the circular zones are located on each side of the line B—B. The circular zones located farthest away from line B—B are referred to as wing zones 45 while the circular zones located closest to line B—B are referred to back zones 47. Thus, each area of play has, looking towards the neutral area from the respective long edge surface 25, right and left wing zones 45 and right and left back zones 47. The back zones 47 are located more closely to the respective long edge surfaces 25 than are the wing zones. Inside each wing and back zone are five small circles 51 used for positioning the men within the zones. One of the positioning circles 51 is located in the center of each of the wing and back zones. The centers of the other four positioning circles 51 are located along respective imaginary lines that are parallel to respective imaginary lines A—A and B—B. The positioning circles 51 within each zone have numerical markings from 1 to 5, with the center positioning circle being marked with the number 1. Within each zone 45 or 47 a man may be positioned only within one of the circles 1, 2, 3, 4, or 5. A man cannot be located outside his zone 45, 47, or 49. The semi-circular or center zones 49 symetrically straddle line B-B so as to have the respective flat sides abut the boundary of the neutral area in each area of play. The center zones 49 have no positioning circles located therein.

Scoring pockets 53 are provided in each area of play (see FIGS. 1 and 2). The scoring pockets 53 include openings formed by notches 55, 57 cut into the board edge surfaces and the side walls 27. Notches 55 in the shape of quarter circles are located in each corner of the playing board 13 and notches 57 in the shape of semi-circles are located at the junctions of line B—B and the long edge surfaces 25. The side walls 27 extend across the notches to complete the scoring pocket openings. The openings are large enough to allow the playing ball to pass therethrough. The openings lead to the interiors of the scoring pockets 53 which are formed by those portions of the side walls extending beneath the playing board and interior vertical walls 59 that extend between the bottom wall 29 and the rim of the respective notch 55, 57. The interior vertical walls 59 prevent the ball from exiting the interiors of the scoring pockets and entering the space between the bottom wall 29 and the playing board 13 where the ball can become trapped. The side walls 27 have openings 61 opposite the interior vertical walls 59 to facilitate the removal of the ball from the respective scoring pockets 53.

Figure 6:
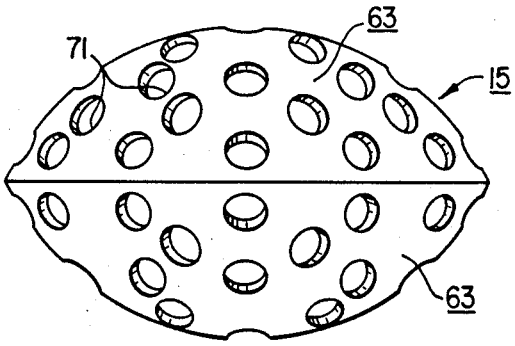
FIG. 6 is a schematic elevational view of the playing ball of FIG. 3.

Referring to FIGS. 3 and 6, the playing ball 15 includes two bowl shaped portions 63 and an inner ball 65. The two bowl shaped portions 63 are substantially identical to one another, with each having a circular open end 67. The bowl shaped portions 63 are joined together at the open ends by suitable adhesive means to form an interior space 69. Each bowl shaped portion 63 is a portion of a hemisphere with a diameter of the open end 67 being greater than twice the height of the bowl shaped portion, thus insuring that each bowl shaped portion is less than a full hemisphere and that the playing ball 15 is nonspherical. The bowl shaped portions are perforated with openings 71 that communicate between the interior space 69 and the exterior of the playing ball 15. The inner ball 65 is spherical and of smaller diameter so as to fit loosely into the interior space 69. Thus, when the ball is hit, the inner ball is free to move around inside and disturb the stability of the playing ball. Furthermore, the openings 71 increase the drag on the ball.

Each stick 17 has an upper and a lower end with a longitudinal axis of the stick extending between the two ends (see FIG. 4). The upper end has a handle 73 or grip. The lower end has a foot shaped protuberance 75 that projects radially outward at an approximate right angle to the longitudinal axis of the stick. The foot portion 75 has toes 77, a heel 79, and sides 81. Thus the surfaces of the foot portion 75 are irregular.

Figure 7:
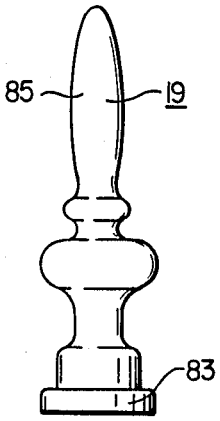
FIG. 7 is a schematic elevational view of the men of FIG. 1.

The men 19 are generally cylindrical in shape having base portions 83 and upper portions 85 (see FIG. 7). The base portions 83 are sized so as to fit within the positioning circles 51 of the zones 45, 47 and are of a shape so as to allow the men to be placed in vertical positions upon a playing board 13. Each man 19 is sufficiently solid enough so as not to be easily toppled when struck by the playing ball. There are five men 19 located in each area of play 33, 35, with one man in each zone. For ease in visual distinction, the men in the first area of play 33 and the men in the second area of play 35 are contrastingly colored.

Typical dimensions for the board version equipment are as follows: the playing board 13 is 20 inches along the short edge surfaces 23 and 30 inches along the long edge surfaces 25. The side walls 27 extend about 2.5 inches above the top surface of the playing board 13. The areas of play 33, 35 are each 7.5 inches wide and the neutral area 37 is 5 inches wide. The scoring pocket notches 55, 57 each have a radius of 1.25 inches and the scoring pockets are 1.5 inches deep. The zones 45, 47, 49 each have a radius of 2 inches. The centers of the wing zones 45 are located 5 inches from the respective long edge surfaces 25 and 4 inches from the respective short edge surfaces 23. The centers of the back zones 47 are located 3 inches from the respective long edge surfaces 25 and 9.5 inches from the respective short edge surfaces 23. The centers of the center zones 49 are located 7.5 inches from the respective long edge surfaces 25 and 15 inches from the short edge surfaces. The positioning circles are 0.7 inches in diameter. The playing ball 15 is 1 inch in diameter at the open ends 67 of the bowl shaped portions 63. The overall height of the playing ball 15 is $\frac{5}{8}$ inches. The wall thickness of the bowl shaped portion 63 is 1/16 inches and each bowl shaped portion 63 has 5 openings 71 that are 3/16 inches in diameter. The playing ball bowl shaped portions may be made of plastic, rubber or some other suitable material. The inner ball 65 is $\frac{1}{2}$ inches in diameter. The inner ball, which may be made of plastic, rubber, steel or some other suitable material, may be either solid or hollow provided that the inner ball has sufficient weight to move around inside of and destabilize the playing ball. The playing ball 15 weighs about 1.25 ounces. A stick 17 is provided for each player. Each stick 17 is 9 inches in length. The foot shaped portion 75 is approximately 1.25 inches long and 0.25 inches in height. The weight of each stick 17 is about 2 ounces. The vertical playing men 19 weigh about 5 ounces and are 3.5 inches tall. The base portion 83 has a diameter of about, 0.7 inches and the largest diameter of the upper portion 85 is about 0.7 inches.

The method of how the board version of the game is played will now be described. The playing board 13 along with its rectangular container of the side walls 27 and the bottom wall 29 are placed upon a flat horizontal surface such as a table (not shown). The game is played by two opposing sides; one side per area of play 33, 35.

Each side has one or two human players (not shown) who manipulate the sticks for offensive and defensive purposes and who also move the men for defensive purposes. The object of the game is for each side in turn to alternately strike the playing ball 15 with a stick in one side's own area of play in an attempt to place the ball in one of the scoring pockets 53 located in the other side's area of play thereby scoring points; and then defend against the placing of the ball by the other side within the scoring pockets located in the area of play of the one side. The playing ball 15 is struck with the foot portion 75 of the stick 17. During play, no part of the stick may enter the neutral area 37 or the opposing side's area of play.

The game is divided into a plurality of time periods. It has been found in practice that two five minute halves are satisfactory time periods. A man 19 is positioned within each one of the wing, back and center zones 45, 47, 49. During play, the men cannot leave their respective zones.

At the start of each time period, the men are positioned within the center positioning circle marked with a number 1, in the wing and back zones 45, 47. In the center zones 49, the men may be positioned anywhere within the zones. Play is initiated by one side hitting the ball which is located on the center spot 39 within the neutral area 37. When hitting the ball out of the neutral area, the ball must contact either a portion of one of the side walls bordering the opposing side's area of play, one of the opposing side's men, or the opposing side's stick, before being placed into a scoring pocket. These constraints prevent the side that initiates play from scoring too easily. Once play is initiated, the ball is hit back and forth across the neutral area until one side scores by hitting the ball into a scoring pocket or the playing action has stopped for some other reason.

To more clearly illustrate the sequence of play, it will be convenient to refer to a first side, occupying the first area of play 33 and a second side, occupying the second area of play 35. Each side has one player; thus there is a first player and a second player. After the board is set up and the men are properly positioned, the first player initiates play by placing the ball 15 on the center spot 39 and striking it with a stick into the second area of play 35. The first player should not directly aim for one of the scoring pockets in the second area of play, since the ball must contact one of the side walls within the second area of play, one of the second side's men or the second player's stick before going into a scoring pocket. The second player defends and tries to prevent the ball from going into one of the scoring pockets in the second area of play with his stick and by moving his men around between positioning circles within their respective zones. Once the ball enters the second area of play, the second player strikes the ball with his stick and attempts to hit the ball into one of the scoring pockets into the first area of play 33. The second player attempts to drive the ball into the scoring pockets located in the first area of play through any one of six passing lanes, or by deflections off of the side walls, the first player's stick or the first side's men. Passing lanes exist between the short side walls and the wing men, the wing men and the back men, and the center men and the back men. The first player, who in the meantime has withdrawn his stick from the neutral area, tries to prevent the ball from entering the scoring pockets in the first area of play by manipulating his stick and men. When either striking the ball or defending, by whichever player, and after play has been initiated, the sticks must not enter the neutral area, or a fault will be assessed. Once the ball enters the first area of play, the first player may likewise strike the ball with his stick and attempt to hit the ball into one of the scoring pockets in the second area of play 35. Play continues in this manner until the action is stopped.

In order to score, the ball must go into one of the scoring pockets 53 via the respective notches 55, 57. If the ball rebounds out of the scoring pocket, no score is awarded. Also, if a player puts the ball into one of the scoring pockets located within his own area of play, the score is awarded to the opposing side. It has been found in practice that a satisfactory scoring system entails the awarding of one point for each time the ball is placed into one of the corner scoring pockets and two points for each time the ball is placed into one of the center scoring pockets. The player with the largest number of points at the end of the game wins.

It has been found in practice that the faster the game is played, the more enjoyable it becomes. Thus, continuous play is encouraged by requiring the players to strike the ball within one second after the ball has come to rest within the respective area of play.

The degree of difficulty is increased if each player is required to move each of his wing men and back men to at least one other positioning circle in its respective zone during each time period and that only after all four men have been moved once can a player move a man that has been moved already. Once all four men have been moved at least once, the men may be freely moved to other positioning circles within their respective zones.

When play is interrupted, the ball is placed on the nearest restart spot 41 and the player whose turn it would have been, had play not been interrupted, restarts play by striking the ball. Play is interrupted if the ball is hit off of the board, if the ball comes to a stop in the neutral area and the player who hit it there did so unintentionally, or after the assessment of a fault. Play is also interrupted after the ball is placed in a scoring pocket; however, play is reinitiated from the center spot 39 by the player who scored.

A fault is assessed to the player that causes any of the following situations: a stick enters the neutral area during play (except during the initiation of play); the ball leaves the board; during initiation of play from the neutral area the ball is driven directly into a scoring pocket without contacting first the opposing side's side wall, stick or men; one of the wing men or back men is not moved during a time period; a wing man or back man is moved for a second time before all of the wing men or back men have been moved once; any one of the men is positioned substantially outside of a positioning circle 51; any part of a players body comes in contact with the ball (except during positioning the ball or initiation of play); any one of the men falls over from its vertical position; holding any one of the men while that man contacts the ball; and taking too much time to hit the ball. For each time period, each side has a set number of "free" faults in the sense that no penalty is assessed. For example, for a five minute half, each side has five free faults. If more than five faults are assessed, then for each additional fault, a point is deducted from the score of the assessed side.

Variations in the number and duties of the players may occur when playing the game. For example, two players per side may play. Each player may operate a stick and move some of the men, or one player may operate a stick while the other moves all of the men. If one player per side plays, then each player must operate a stick and move the men. Another variation allows each player to operate two sticks, one stick for each hand.

It is preferable to play the game with a third person acting as a referee, but if none is available, each player can identify the other player's faults.

The game of the present invention can also be played on a court. The court version of the game will now be described, with particular reference to FIG. 5. Equipment for playing the court version of the game of the present invention includes a court 87, a playing ball 15, and sticks 17.

Figure 5:
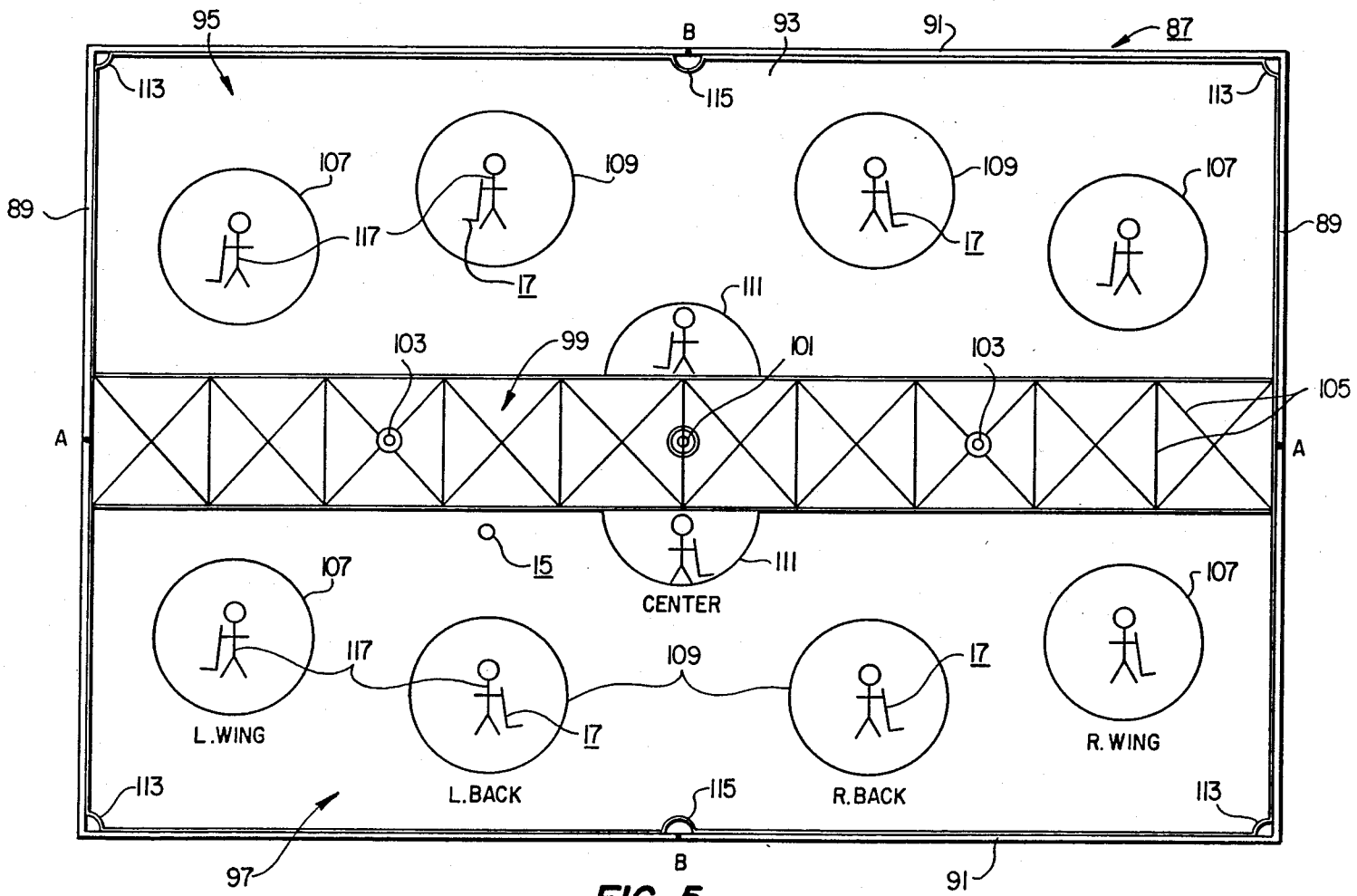
FIG. 5 is a plan view of the playing court which is utilized in the court version of the present invention.

The court 87 is rectangular in shape and may be of the indoor variety with a hardwood floor or of the outdoor variety with a grass lawn surface. The indoor court, which is shown in FIG. 5, has short and long transparent side walls 89, 91. The side walls are oriented perpendicularly to the floor surface 93. Side walls 89, 91 extend above the floor surface a sufficient distance so as to provide a reflective surface for the ball.

Like the top surface of the board 13 in the board version described above, the floor surface 93 of the court has markings dividing the floor surface into first and second areas of play 95, 97 and a neutral area 99. Also, like the board version, the three areas are rectangular in shape and are positioned relative to each other such that the first and second areas of play 95, 97 are separated from one another by the neutral area 99. The neutral area 99 extends between the short side walls 89. The two areas of play have the same areal dimensions. As in the description of the board markings, it will be convenient to refer to imaginary lines A—A and B—B in FIG. 5, which lines are the perpendicular bisectors of the short side walls 89 and the long walls 91 respectively. The neutral area 99 of the court has a center spot 101 and restart spots 103 in the same relative positions as on the playing board 13 described above. The neutral area 99 also has numerous linear and cross markings 105. Each area of play has left and right wing zones 107, left and right back zones 109 and a center zone 111 in the same relative positions as on the playing board 13. The wing zones and back zones 107, 109, unlike the playing board zones, have no positioning circles.

Scoring pockets 113, 115 are located at all of the corners and at mid-court which is the junction of line B-B and the long side walls 91. Thus, each area of play is provided with three scoring pockets. Each scoring pocket 113, 115 has an opening in the floor surface that leads to a cup (not shown) located beneath the floor surface. The openings are large enough to allow the ball to pass therethrough. The corner scoring pockets 113 have openings in the shape of a quarter circle, while the mid-court scoring pockets 115 are semi-circular in shape. The cups are of course deep enough to fully receive the ball.

The playing ball 15 and stick 17 used in the court version are, except for dimensional characteristics, the same as those described above in conjunction with the board version. The court version of the game does not utilize the inanimate men as in the board version; instead human players occupy the zones as will be explained in more detail hereinafter.

Typical dimensions for the court version equipment are as follows: the court is 60 feet along the short side walls 89 and 90 feet along the long side walls 91. The side walls 89, 91 extend about 5 feet above the floor surface 93 of the court 87. The areas of play 95, 97 are each 25 feet wide and the neutral area 99 is 10 feet wide. The openings of the scoring pockets 113, 115 each have a radius of 1 foot and the cups are 1 foot deep. The centers of the restart spots 103 are located 30 feet from the long side walls 91 and 22.5 feet from the respective short side walls 89. The zones 107, 109, 111 each have a radius of 6 feet. The centers of the wings zones 107 are located 15 feet from the respective long side walls 91 and 11.25 feet from the respective short side walls 89. The centers of the back zones 109 are located 10.5 feet from the respective long side walls 91 and 30.5 feet from the respective short side walls 89. The centers of the center zones 111 are located 25 feet from the respective long side walls 91 and 45 feet from the respective short side walls 89. The playing ball 15 is 5 inches in diameter at the open ends 67 of the bowl shaped portions. The overall height of the playing ball 15 is 3 inches. The wall thickness of the bowl shaped portion 63 is ¼inches and the openings 71 are ½inches in diameter. The inner ball 65 is 2 inches in diameter. The playing ball bowl shaped portions and inner ball may be made of the same material as described above for the board version playing ball. The inner ball may be solid or hollow, as in the board version playing ball, provided the inner ball has sufficient weight to move around inside of and destabilize the playing ball. The ball weighs about 5 ounces. Each stick 17 is 55 inches in length. The foot portion 75 is approximately 6 inches long and 2 to 3 inches in height. The weight of each stick is about 25 ounces.

The method of how the court version is played will now be described. The game is played by two opposing sides; one side per area of play 95, 79. Each side has a team of five human players 117 who are confined to their respective zones during play and who manipulate the sticks for offensive and defensive purposes. The object of the game is the same for both the board version and the court version in that each side in turn to alternately strike the ball with a stick in one side's own area of play in an attempt to place the ball in one of the scoring pockets located in the other side's area of play thereby scoring points; and then defend against the placing of the ball by the other side within the scoring pockets located in the area of play of the one side.

The ball is struck with the foot portion 75 of the stick 17. Thus the ball may be struck with the toes 77, heel 79, or sides 81 of the foot portion 75. The stick may be used in a backhand or a forehand manner and may be used to trap and or reposition the ball in addition to striking the ball. (The above stick handling techniques are applicable to the board version of the game as well.) Players may contact the ball with their own feet. Although the players are confined to their respective zones, they may hit the ball with a stick regardless of where the ball is located. Thus, if the ball is located in the neutral area or outside of the player's zone, as long as the player remains within his respective zone, he may strike the ball with his stick.

At the start of each time period or after a score has occurred, the players position themselves within the centers of their respective zones. The center man from the initiating side enters the neutral area 99, where the ball has been placed on the center spot 101 and strikes the ball. The center man can hit the ball forward into the opposing side's area of play or backward to a player on his own side. In either case, a fault will be assessed if the ball is driven into a scoring pocket by the initiating side without having first contacted one of the side walls bordering the opposing side's area of play or one of the opposing player's sticks. After striking the ball in the neutral area, the center man must return to his zone as quickly as possible, and the ball is hit back and forth across the neutral zone until one side scores by hitting the ball into a scoring pocket or the playing action is stopped for some other reason. After play is initiated, the players may move freely around inside of their respective zones. The players on one side can pass the ball between themselves before hitting it across to the other side. Scoring for the court version of the game is the same as for the board version.

Continuous play is encouraged by requiring the players to strike the ball within two seconds after the ball has come to rest within the respective area of play. A maximum of three contacts with the ball by the players on one side are allowed before the ball must be hit across to the opposing side. A contact is any contact between the ball and either a player's foot or stick.

When play is interrupted, the ball is placed on the nearest restart spot 103 and the closest wing player or back player of the side whose turn it would have been had play not been interrupted restarts play by striking the ball. Play is interrupted during the court version of the game if the ball is hit off of the court, if the ball comes to a stop in the neutral area and no player can reach it with his stick, or after the assessment of a fault.

A fault is assessed to the side causing any of the following situations: the ball leaves the court; during initiation of play from the neutral area the ball is driven directly into a scoring pocket without contacting first one of the side walls bordering the opposing side's area of play or one of the opposing player's sticks; one of the players leaves his zone (except during initiation of play); any part of a players body comes in contact with the ball (except feet); and taking too much time to hit the ball. As for the board version, each side is alotted a certain number of "free" faults where no penalty is assessed. For each fault above the number of free faults, one point is deducted from the score of the assessed side.

The game may be played with some variation from the above description. For example, the degree of difficulty is increased if the players wear roller skates on the hardwood floors. The degree of difficulty may be decreased slightly if in each wing and back zone there are two players instead of just one.

The foregoing disclosure and the shownings made in the drawings are merely illustrative of the principles of this invention and are not to be interpreted in a limiting sense.

I claim:

1. A game, comprising:

a rectangular board having a top surface and edge surfaces, said top surface having markings dividing the top surface into areas, said areas comprising two rectangular areas of play, with said areas of play separated from one another by a neutral area, said markings further delineating zones within each area of play, side wall means extending along said side edge surfaces and oriented transversely to said top surface, said side wall means extending at least above board edge surfaces, a playing ball, scoring pocket means comprising openings formed in said board edge surfaces, said openings being large enough to receive said playing ball, said scoring pocket means bordering said areas of play, with the number of scoring pocket means of one area of play being equal to the number of scoring pocket means of the other area of play, a plurality of stick means for use in striking the ball, said playing ball comprising wall structure having a dimension in one plane which is greater than its dimension in a plane transverse to said one plane, said playing ball having an interior space within said wall structure with a plurality of openings formed through said wall structure so as to allow communication between said interior space of said playing ball and the exterior of said playing ball, with said playing ball having a smaller ball located within said interior space.

2. The game of claim 1 wherein:

said zones are circular in shape and are non-overlapping, each of said stick means has upper and lower ends and comprises a foot shaped protuberance on the lower end projecting outwardly from said stick means at an approximate right angle form the stick means longitudinal axis, where in said ball is struck with the protuberance.

3. A game, comprising:

a rectangular board having a top surface and edge surfaces, said top surface having markings dividing the top surface into areas, said areas comprising two rectangular areas of play, with said areas of play separated from one another by a neutral area, said marking further delineating zones within each area of play, side wall means extending along said side edge surfaces and oriented transversely to said top surface, said side wall means extending above and below said board edge surfaces, a playing ball, scoring pocket means comprising openings formed in said board edge surfaces and said side wall means, said openings being large enough to allow said playing ball to pass therethrough, said scoring pocket means bordering said areas of play, with the number of scoring pocket means of one area of play being equal to the number of scoring pocket means of the other area of play, said areas of play each having plural scoring pocket means, a plurality of stick means for use in striking the ball, a plurality of playing pieces, wherein said pieces are to be located in said zones so as to form lanes for the passage of said playing ball into said respective scoring pocket means, said lanes being formed between adjacent playing pieces and between said playing pieces and said side wall means, said playing pieces being adapted to be located on said board top surface, wherein said playing pieces can be moved from one position to another position on said top surface, said ball comprising two bowl shaped portions, each of which has an open end, with the diameter of the open end being greater than twice the height of the bowl shaped portion, said bowl shaped portions joined together at the open ends to form an interior space, said bowl shaped portions having a plurality of openings so as to allow communication between the interior space of said ball and the exterior of said ball, with said ball having a smaller ball located within said interior space.

4. A game, comprising:

a rectangular board having a top surface and edge surfaces, said top surface having markings dividing the top surface into areas, said areas comprising two rectangular areas of play, with said areas of play separated from one another by a neutral area, said markings further delineating zones within each area of play, side wall means extending along said side edge surfaces and oriented transversely to said top surface, said side wall means extending above and below said board edge surfaces, a playing ball, scoring pocket means comprising openings formed in said board edge surfaces and said side wall means, said openings being large enough to allow said playing ball to pass therethrough, said scoring pocket means bordering said areas of play, with the number of scoring pocket means of one area of play being equal to the number of scoring pocket means of the other area of play, said areas of play each having plural scoring pocket means, a plurality of stick means for use in striking the ball, a plurality of playing pieces, wherein said pieces are to be located in said zones so as to form lanes for the passage of said playing ball into said respective scoring pocket means, said lanes being formed between adjacent playing pieces and between said playing pieces and said side wall means, said playing pieces being adapted to be located on said board top surface, wherein said playing pieces can be moved from one position to another position on said top surface, said zones are circular in shape and are nonoverlapping, each of said stick means has upper and lower ends and comprises a foot shaped protuberance on the lower end projecting outwardly from said stick means at an approximate right angle from the stick means longitudinal axis, wherein said ball is struck with the protuberance, said ball comprises two bowl shaped portions, each of which has an open end, with the diameter of the open end being greater than twice the height of the bowl shaped portion, said bowl shaped portions joined together at the open ends to form an interior space, said bowl shaped portions having a plurality of openings so as to allow communication between the interior space of said ball and the exterior of said ball, with said ball having a smaller spherical ball located within said interior space.

* * * * *